US009347262B1

(12) United States Patent
Richard

(10) Patent No.: US 9,347,262 B1
(45) Date of Patent: May 24, 2016

(54) GATE

(71) Applicant: Leroy Richard, Kindred, ND (US)

(72) Inventor: Leroy Richard, Kindred, ND (US)

( * ) Notice: Subject to any disclaimer, the term of this patent is extended or adjusted under 35 U.S.C. 154(b) by 488 days.

(21) Appl. No.: 13/837,327

(22) Filed: Mar. 15, 2013

(51) Int. Cl.
*E04H 17/18* (2006.01)
*E06B 11/02* (2006.01)

(52) U.S. Cl.
CPC ..... *E06B 11/02* (2013.01)

(58) Field of Classification Search
CPC ..... A01K 3/00; E04H 17/00; E04H 17/14; E04H 17/16; E04H 17/18; E04H 17/1413
See application file for complete search history.

(56) References Cited

U.S. PATENT DOCUMENTS 3,875,699 A * 4/1975 Lamarre ..... A01G 25/00 138/115
4,093,187 A 6/1978 Robinson
4,465,262 A 8/1984 Itri
4,583,715 A 4/1986 Wright
D286,690 S * 11/1986 Priefert ..... D30/119
4,624,072 A 11/1986 Zilkha
4,727,702 A * 3/1988 Baker ..... E06B 11/02 49/381
4,793,098 A 12/1988 Wilkerson
4,836,143 A * 6/1989 Shadbolt, Jr. ..... A01K 3/00 119/514
5,312,089 A * 5/1994 Venegas, Jr. ..... E04F 11/181 256/19
5,471,809 A * 12/1995 Frankel ..... E04C 3/29 138/114
6,178,693 B1 1/2001 Hunt
6,499,435 B2 12/2002 Markham
7,100,904 B2 * 9/2006 Kim ..... E04H 17/1434 256/22
2002/0096673 A1 7/2002 Siel
2008/0296548 A1 * 12/2008 McDonald ..... A01K 1/0005 256/26
2011/0001106 A1 1/2011 Lee

* cited by examiner

*Primary Examiner* — Michael P Ferguson
(74) *Attorney, Agent, or Firm* — Jeffrey A. Proehl; Woods, Fuller, Shultz & Smith, P.C

(57) ABSTRACT

A gate for use in closing the opening in a fence may comprise a plurality of horizontal bars separated by open spaces, with at least some of the horizontal bars being formed of hollow tubing having a primary perimeter wall with an interior surface defining an interior lumen. A plurality of vertical elements may connect the horizontal bars, and at least one reinforcement member may be inserted into the interior lumen of one of the horizontal bars. The at least one reinforcement member may have an exterior surface with locations on the exterior surface in snug contact with the interior surface of the primary perimeter wall.

3 Claims, 2 Drawing Sheets

GATE

BACKGROUND

Field

The present disclosure relates to gates and more particularly pertains to a new gate with enhanced strength characteristics.

SUMMARY

In one aspect, the present disclosure relates to a gate for use in closing the opening in a fence, with the gate having an inboard end and an outboard end. The gate may comprise a plurality of horizontal bars separated by open spaces, with at least some of the horizontal bars being formed of hollow tubing having a primary perimeter wall with an interior surface defining an interior lumen. A plurality of vertical elements may connect the horizontal bars. At least one reinforcement member may be inserted into the interior lumen of one of the horizontal bars, with the at least one reinforcement member having an exterior surface with locations on the exterior surface in snug contact with the interior surface of the primary perimeter wall.

In another aspect, the present disclosure relates to a gate for use in closing the opening in a fence, with the gate having an inboard end and an outboard end. The gate may comprise a plurality of horizontal bars separated by open spaces, with at least some of the horizontal bars being formed of hollow tubing having a primary perimeter wall with an interior surface defining an interior lumen. A plurality of vertical elements may connect the horizontal bars, with the plurality of vertical elements including vertical bars joining the ends of the horizontal bars and vertical elements positioned between the vertical bars and linking the horizontal bars. A plurality of reinforcement members may each be inserted into the interior lumen of one of the horizontal bars, with each of the reinforcement members having an exterior surface with locations on the exterior surface secured to locations on the interior surface of the primary perimeter wall.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
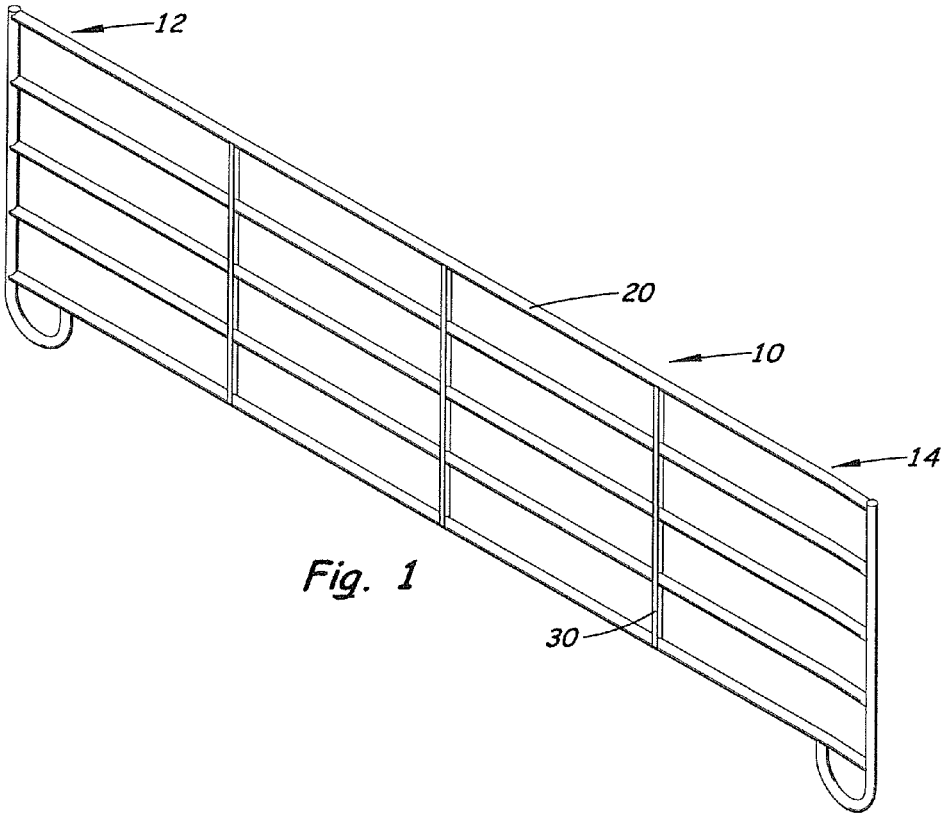
FIG. 1 is a schematic perspective view of a new gate according to the present disclosure.
Figure 2:
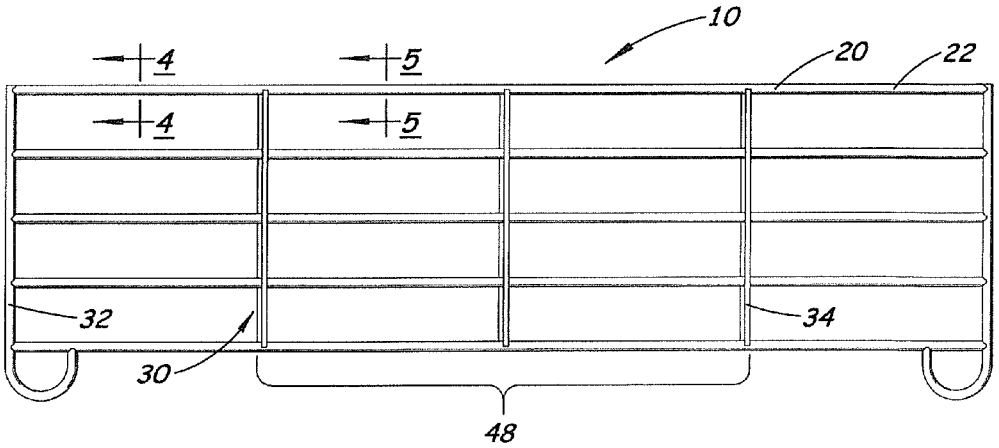
FIG. 2 is a schematic front view of the gate, according to an illustrative embodiment.
Figure 3:
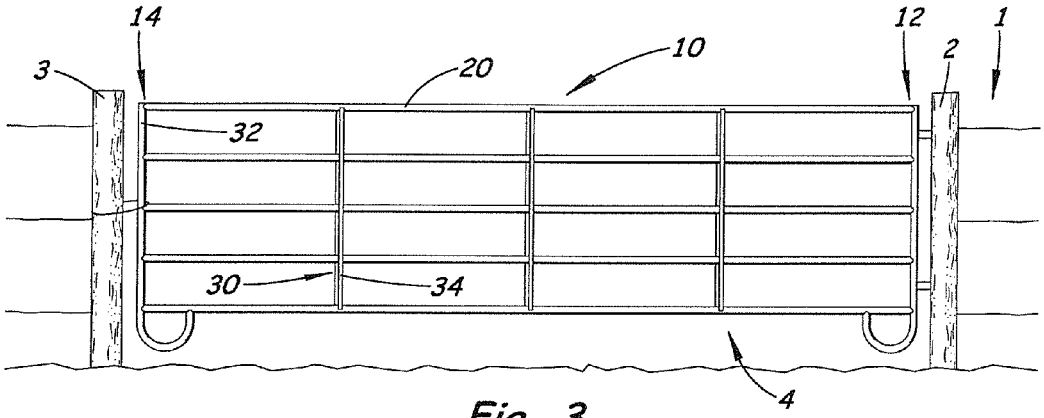
FIG. 3 is a schematic front view of the gate mounted with a fence, according to an illustrative embodiment.
Figure 4:
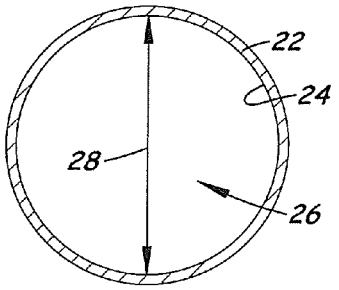
FIG. 4 is a schematic cross section view of a portion of a horizontal bar of the gate taken at line 4-4 in FIG. 2, according to an illustrative embodiment.
Figure 5:
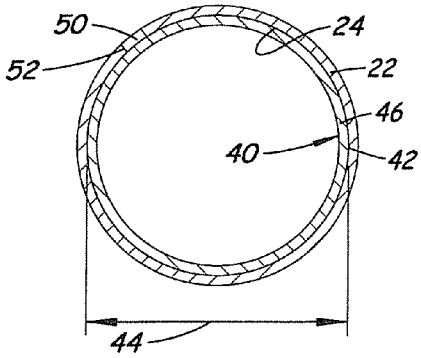
FIG. 5 is a schematic cross section view of a portion of the horizontal bar of the gate taken at line 5-5 of FIG. 2, according to an illustrative embodiment.

With reference now to the drawings, and in particular to FIGS. 1 through 6 thereof, a new gate embodying the principles and concepts of the disclosed subject matter will be described.

Applicant has recognized that gates, and in particular gates utilized in agricultural fences, supported in a cantilevered manner from a support post have a tendency to sag or droop after a period of time. Additionally, over a period of time such gates will be struck by vehicles passing through the fence opening. The applicant has recognized that increasing the thickness, or gauge, of the material forming the gate may provide strength, but comes at the cost of increased cost in fabricating the gate as well as increased weight that may make the gate more difficult to operate and put additional stress on the fence post supporting gate, which in turn can lead to sagging of the gate due to bending of the fence post.

The applicant has developed a gate that has increased strength to resist the tendency to sag and resist damage from being struck by vehicles. The increase in strength may be accomplished without significantly increasing the weight of the gate. Applicant has devised a manner of reinforcing portions of the gate that are more significant to the gate's strength without reinforcing portions of the gate that are less important to the gate's strength. This selective reinforcement may even allow portions of the typical gate to be eliminated to offset any weight increase.

The applicant has devised a manner of reinforcing and strengthening the middle portion of the gate where sagging and damaging contact is most likely to occur, without directly reinforcing the end portions of the gate. The reinforcement may be accomplished by inserting a reinforcement member into one or more of the generally hollow horizontal bars of the gate, and positioning the reinforcement members toward a center portion of the length of the bar with the end portions of the bar not including the reinforcement member. In many implementations, one or possibly more of the horizontal members may be eliminated from the gate (as compared to conventional designs) to help offset the weight of the reinforcement member or members added to the gate.

The additional weight contributed to the gate by the inner tube may be compensated for by eliminating one of the horizontal bars that are typically included on a conventional farm gate, due to the added strength provided by the novel configuration.

The disclosure is thus directed to a gate 10 for use in closing the opening in a fence 1 which may have spaced posts 2, 3, that may define an opening 4 in the fence line that may be closed by the gate. The gate 10 may have an inboard end 12 and an outboard end 14 with a distance between the inboard and outboard ends defining a length of the gate. The length of the gate may generally correspond to the width of the opening 4 in the fence line, although the length of the gate is typically some shorter than the opening width. The inboard end 12 may be configured to pivotally mount on the support post 2, such as by hinges, so that the outboard end 14 swings in an arc about the support post 2. Typically, such gates may be utilized in an agricultural field, although the invention is not so limited.

The gate 10 may include a plurality of horizontal bars 20 which are typically separated by open spaces or gaps therebetween, and may be orientated substantially parallel to each other. Often, the gate will include five of the horizontal bars, although with the use of aspects of the present disclosure, four or possibly fewer bars 20 may be employed on a gate. At least some of the horizontal bars 20 may be formed of hollow tubing, and in some of the most preferred embodiments all of the bars 20 will be substantially hollow. The hollow bars may be formed with a primary perimeter wall 22 which may have an interior surface 24 that defines an interior lumen. The interior surface and interior lumen of the horizontal bars may have an inner diameter 28. Additionally, the horizontal bars 20 may have a fixed length.

The gate 10 may also include a plurality of vertical elements 30 that may connect the horizontal bars 20. The vertical elements 30 may include vertical bars 32 that are located at the inboard 12 and outboard 18 ends of gate, and may connect ends of the horizontal bars together. The vertical elements 30 may also include vertical braces 34 that support the horizontal bars in vertically spaced positions. The vertical braces 34 may be positioned between the vertical bars toward the center of the gate between the ends. In some embodiments, the braces 34 may be formed of sheet or flat stock, with the horizontal bars 20 passing through holes formed in the braces. The vertical braces 34 may divide the gate into sections or panels, and the number of panels may depend upon the relative length of the gate. In some embodiments, two vertical braces 34 may divide the gate into three panels, and in other embodiments three vertical braces divide the gate into four panels.

At least one reinforcement member 40 may be employed to reinforce or strengthen at least one of the horizontal bars 20. The reinforcement member 40 may be enclosed in the respective horizontal bar, and the member 40 may be inserted into the interior lumen 26 of the associated horizontal bar, and may be wholly inserted therein. In some of the most preferred embodiments, a reinforcement member 40 is utilized for each of the bars 20 of the gate, although this is not critical, and reinforcement members may be used on, for example, alternating bars 20, uppermost and lowermost bars 20, interior bars 20, etc.

The reinforcement member 40 has an exterior surface 42 that in at least some locations is in snug contact with the interior surface 24 of the primary perimeter wall 22. The snug or intimate contact may still permit relatively free movement of the reinforcement member into the primary perimeter wall. The exterior surface 42 may have a major width or outer diameter 44. Significantly, the outer diameter or major dimension of the secondary perimeter wall 46 may be just slightly smaller than the inner diameter 28 of the primary perimeter wall to cause contact between the reinforcement member and the primary perimeter wall of the bar 20 in a number of locations, although complete and total contact between the member 40 and primary perimeter wall 22 is not critical.

Figure 6:
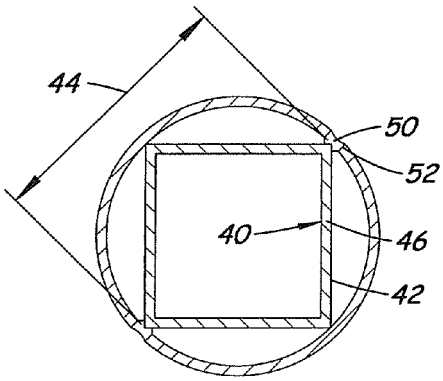
FIG. 6 is a schematic cross section view of an optional horizontal bar configuration of the gate, according to an illustrative embodiment.

The reinforcement member 40 may comprise a hollow tube having a secondary perimeter wall 46. In some embodiments, the primary 22 and secondary 46 perimeter walls may each have a substantially circular cross sectional shape (see, e.g., FIG. 5). In other embodiments, the primary perimeter wall 20 has a circular cross sectional shape and the secondary perimeter wall 46 has a rectangular cross sectional shape (see, e.g., FIG. 6). As is illustrated in the embodiment of FIG. 6, contact between the secondary perimeter wall and the primary perimeter wall may be limited to only a few points The reinforcement member 40 has a length which may be a fraction of the length of the horizontal bar 20 in which the reinforcement member is inserted so that the span 48 of the member 40 is limited to a part of the length of the gate. The reinforcement member 40 has opposite ends, and in some embodiments the ends of the member 40 are each positioned adjacent to one of the vertical braces 34. The secondary perimeter wall 46 of the reinforcement member 40 may thus be shorter in length than the primary perimeter wall 22 of the horizontal bar. In some embodiments, the length of the secondary perimeter wall is approximately half of the length of the primary perimeter wall, although the length of the secondary perimeter wall may be from approximately 25 percent to approximately 75% of the length of the primary perimeter wall, and in some of the more preferred embodiments the secondary perimeter wall has a length from approximately 40% to approximately 60%. In many embodiments, the secondary perimeter wall may be positioned with substantially equal spacing between the ends of the reinforcement member and the respective inboard and outboard ends of the gate, although an eccentric positioned in this dimension may be employed.

The reinforcement member 40 may be secured to the horizontal bars at one or more spaced locations, and the secondary perimeter wall being secured to the primary perimeter wall at locations along the length of the secondary perimeter wall. The securement may resist movement of the reinforcement member along the length of the lumen 26 of the bar 20, and may also function to enhance the reinforcement of the bar 20 by the member 40. Optionally, the primary perimeter wall and the secondary perimeter wall are secured together by crimping the primary perimeter wall onto the secondary perimeter wall. As a further option, the primary perimeter wall and the secondary perimeter wall may be secured by a spot weld 50 attaching the walls 22, 46 together, such as by forming a hole in the primary perimeter wall and welding the exposed surface of the secondary perimeter wall to the edges of the hole in the primary perimeter wall.

In some implementations, the secondary perimeter wall may be formed of a material having a thinner thickness than a material forming the primary perimeter wall, although this is not critical.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A gate for use in closing an opening in a fence, the gate having an inboard end and an outboard end, the gate comprising:

a plurality of parallel horizontal bars separated by open spaces, each of the horizontal bars being formed of hollow tubing having a primary perimeter wall having a circular cross-sectional shape with an interior surface defining an interior lumen;

a plurality of parallel vertical elements connecting the horizontal bars, the vertical elements including hollow vertical bars joining the ends of the horizontal bars at the inboard and outboard ends of the gate and vertical braces positioned between the vertical bars and supporting the horizontal bars in vertically spaced positions;

a reinforcement member being inserted into the interior lumen of at least two of the horizontal bars, each reinforcement member comprising a hollow tube having a secondary perimeter wall having a rectangular cross-sectional shape having an exterior surface with locations on the exterior surface in snug contact with the interior surface of the primary perimeter wall; and wherein each reinforcement member has opposite ends and a length that is shorter than a length of the horizontal bar into which the reinforcement member is inserted, each reinforcement member being positioned substantially centrally in the horizontal bar with each of the ends thereof being positioned adjacent to one of the vertical braces.

2. A gate for use in closing an opening in a fence, the gate having an inboard end and an outboard end, the gate comprising:

a plurality of parallel horizontal bars separated by open spaces, each of the horizontal bars being formed of hollow tubing having a primary perimeter wall having a circular cross-sectional shape with an interior surface defining an interior lumen;

a plurality of parallel vertical elements connecting the horizontal bars, the vertical elements including hollow vertical bars joining the ends of the horizontal bars at the inboard and outboard ends of the gate and vertical braces positioned between the vertical bars and supporting the horizontal bars in vertically spaced positions;

a reinforcement member being inserted into the interior lumen of at least two of the horizontal bars, each reinforcement member comprising a hollow tube having a secondary perimeter wall having a rectangular cross-sectional shape having an exterior surface with locations on the exterior surface in snug contact with the interior surface of the primary perimeter wall;

wherein each reinforcement member has opposite ends and a length that is shorter than a length of the horizontal bar into which the reinforcement member is inserted, each reinforcement member being positioned substantially centrally in the horizontal bar with each of the ends thereof being positioned adjacent to one of the vertical braces; and wherein a length of the secondary perimeter wall is approximately half of a length of the primary perimeter wall.

3. A gate for use in closing an opening in a fence, the gate having an inboard end and an outboard end, the gate comprising:

a plurality of parallel horizontal bars separated by open spaces, each of the horizontal bars being formed of hollow tubing having a primary perimeter wall having a circular cross-sectional shape with an interior surface defining an interior lumen;

a plurality of parallel vertical elements connecting the horizontal bars, the vertical elements including hollow vertical bars joining the ends of the horizontal bars at the inboard and outboard ends of the gate and vertical braces positioned between the vertical bars and supporting the horizontal bars in vertically spaced positions;

a reinforcement member being inserted into the interior lumen of at least two of the horizontal bars, each reinforcement member comprising a hollow tube having a secondary perimeter wall having a rectangular cross-sectional shape having an exterior surface with locations on the exterior surface in snug contact with the interior surface of the primary perimeter wall;

wherein each reinforcement member has opposite ends and a length that is shorter than a length of the horizontal bar into which the reinforcement member is inserted, each reinforcement member being positioned substantially centrally in the horizontal bar with each of the ends thereof being positioned adjacent to one of the vertical braces; and wherein the secondary perimeter wall is positioned with substantially equal spacing from each of the inboard and outboard ends of the gate.

* * * * *